US006610938B2

(12) United States Patent
Fünfer

(10) Patent No.: US 6,610,938 B2
(45) Date of Patent: Aug. 26, 2003

(54) ROTARY MODE CHANGE SWITCH FOR A HAND TOOL

(75) Inventor: Josef Fünfer, Königsbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/079,791

(22) Filed: Feb. 20, 2002

(65) Prior Publication Data

US 2002/0112943 A1 Aug. 22, 2002

(30) Foreign Application Priority Data

Feb. 21, 2001 (DE) ..... 101 08 124

(51) Int. Cl.[7] ..... H01H 13/62
(52) U.S. Cl. ..... 200/11 R; 200/565
(58) Field of Search ..... 200/11 R, 11 TW, 200/567, 572, 565, 568

(56) References Cited

U.S. PATENT DOCUMENTS 6,294,746 B1 * 9/2001 Yee ..... 200/565

* cited by examiner

*Primary Examiner*—Elvin Enad
*Assistant Examiner*—Lisa N. Klaus
(74) *Attorney, Agent, or Firm*—Sidley Austin Brown & Wood, LLP

(57) ABSTRACT

A rotary mode selection switch (1) for the synchronized switching over of the operating mode of a hand tool. The switch (1) comprising a manually externally actuated driving member (2) and a driven member (3), wherein the driving member (2) includes two eccentrically disposed recesses (5, 5') for receiving two spring elements (6, 6'). The two spring elements (6, 6') include initial front surfaces (7, 7') that contact the driving member (2) and second front surfaces (8, 8') that are oriented in the same direction, wherein with an angle shift ($\alpha$) of the driving member (2) relative to the driven member (3), at least one of the second front surfaces (8, 8') of the spring elements (6, 6') alternately contacts at least one eccentrically disposed contact piece (10, 10', the contact piece axially engaging into the recesses (5, 5'), of the driven member (3).

10 Claims, 1 Drawing Sheet

ROTARY MODE CHANGE SWITCH FOR A HAND TOOL

BACKGROUND OF THE INVENTION

The invention relates to a rotary mode change switch for a hand tool such as a rock drill or a drill driver.

When drilling a rock the sequence of switching operating modes is, for example, Drill <-> hammer <-> position bit <-> cut, which can be switched, reliably and in both directions, wherein each mode is a switch step.

In hand tools having several different movement modes, one mechanical switchover is generally required for each individual operational stage. Conventionally, the switch over is done using external manual, rotationally-resistant and axially switchable displaceable switching elements such as countershafts or switch sleeves.

In rotary mode switches, the angle changeover is actuated externally on the driver part. The changeover is at least partially transformed using an eccentrically disposed pin either directly through direct rotationally-free engagement or indirectly through the translation of auxiliary switching devices into an axial movement of a switching element.

Switching of operating modes is only possible, in a form-fitting arrangement of the bilateral toothing, between the gear pairings of the transmission stages used. To achieve synchronized switching by de-coupling a reliable manually operated mode selection, the drive part can be locally fixed and the switching chain can be resiliently shifted.

DE 3618024 discloses a rotary mode change switch, which is internally spring-biased and rotatable for the synchronized switching of the operating modes of a hand tool. The switch is comprised of a manually operated driving part and an eccentrically disposed pin. The pin is arranged in a recess in the driving part and spring-biased against the recess' eccentric inner wall by a compression spring and is formed by a plurality of locally fixed positions and is switchably moveable along the radial contour of the recess.

EP836902 discloses a mode selection switch, which is rotatable against an internal spring bias, for the synchronized switching of the operating modes of a hand tool. The switch comprises a manually operable driving member and a driven member, which is driven by an eccentrically mounted pin. The driving member and the driven member are axially fixed relative to each other. The driving member and the driven member each include an eccentrically arranged curved recess, wherein each recess is situated opposite the other recess and oriented in a rotational plane perpendicular to a rotational axis of two helical compression springs. The two springs include ends that are alternately in contact with a front face of the recess in the driver member or with a front face of the recess in the driven element. Both compression springs are constantly and axially arranged in the transitional area between the driving member and the driven member due to the relative rotation of the driver member to the driven member. The springs are identically stressed in both directions of rotation such that a mirror-symmetrical setting and biasing process results with respect to the angular shift.

SUMMARY OF THE INVENTION

The object of the present invention is to provide an alternative mode selection switch. A further object of the invention is the formation of a rotational direction dependent, non-mirror-symmetrical setting process with respect to the angular shift.

In accordance with the invention, a rotary mode change switch, which is used for the synchronized switching of the operating modes of a hand tool, comprises an external manually actuated operating driving member and a driven member. The driving member and the driven member are coaxial to each other and are mounted in a fixed and rotationally-resistant manner. Two eccentrically recesses are arranged inside the driving member perpendicular to the rotational axis. Two spring elements each include initial front surfaces that are in contact with the driving part and second front surfaces that are oriented in the same direction. At an angular shift of the driving member relative to the driven member, at least one spring element of the two spring elements is in alternate contact with an eccentrically arranged contact member of the driving member.

Consequently, due to an angular shift of the driving member relative to the driven member, only one of the spring elements arranged inside the axial area of the driving member is constantly stressed.

Preferably, the second front surface of each spring element is provided with a smooth pressure element. The smooth pressure element covers the second front surface such that a low-wear contact of the spring element at the contact member is obtained.

Preferably, the recesses in the driving member, within the rotational plane, are disposed perpendicularly to the rotational axis such that a compact construction of the rotary mode selection switch is possible.

The spring elements are, preferably, compression springs and preferably, helical in shape. As a result, in a compact construction, high bias forces with a substantially linear characteristic curve are obtained.

Preferably, the rotary mode selection switch is mirror-symmetrical. As a result, a magnitude of the bias is independent of the rotary direction relative to the magnitude of the angle shift.

The rotational position of the driving member is preferably fixed by a fixation means that is force-fittingly engaged into the indentations of the driving member. As a result, a one-time manual, externally selected operating mode opposite the housing can be set to be self-limiting. Moreover, an angle shift of the switching, associated with a switch stage corresponding to the switch sequence, up to the point of synchronized switch over of the gears, remains intact. Further, a temporarily stored bias/setting is effected within the switching chain.

The fixation means is preferably a flat spring that engages into the radial indentations of the driving member. The fixation means is technically simple to achieve.

A pin in the driven member is eccentrically arranged and preferably mounted to be freely rotational such that it can be form fitted and rotational resistant connected with a auxiliary switching device, such a as a metal bow.

Other features and advantages of the present invention will become apparent from the following description of the invention which refers to the accompanying drawings.

DETAILED DESCRIPTION OF THE INVENTION

Figure 1:
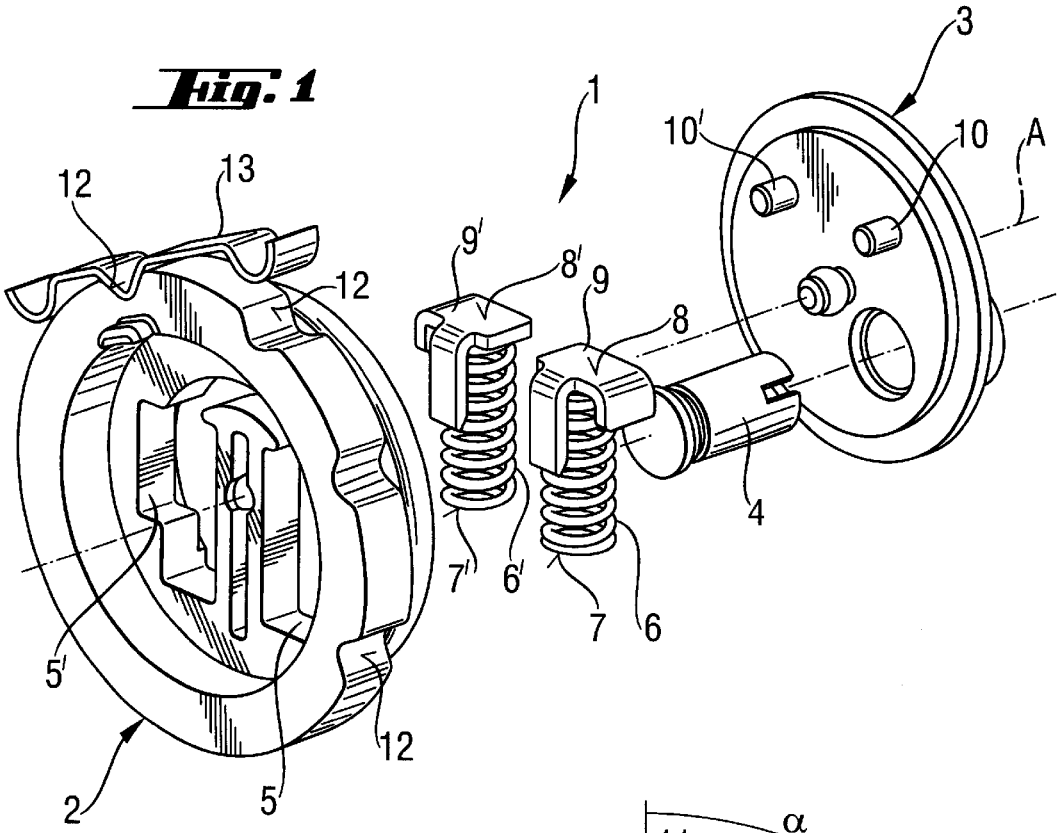
FIG. 1 illustrates an explode veiw of a rotary mode selection switch, in accordance with the invention.

Referring to FIG. 1, a rotary mode selection switch 1 comprises a manually externally operated driving member 2 and a driven member 3, which are axially fixedly mounted such that they are coaxial and freely rotatable relevant to one another. An eccentric pin 4 is freely rotatable and mounted in the driven member 3. Two eccentrically arranged recesses 5, 5' are arranged within the rotational plane, perpendicular to the axis of rotation A of two spring elements 6, 6', preferably, helical compression springs. Spring elements 6, 6' include initial front surfaces 7, 7' that contact the driving member 2 and commonly oriented second surfaces 8, 8' that include two smooth pressure pieces 9, 9' with angled leading surfaces. Second surfaces 8, 8' are arranged eccentrically and axially engage into recesses 5, 5'. Second surfaces 8, 8' communicate with contact members 10, 10' of the driven member 4.

Figure 2:
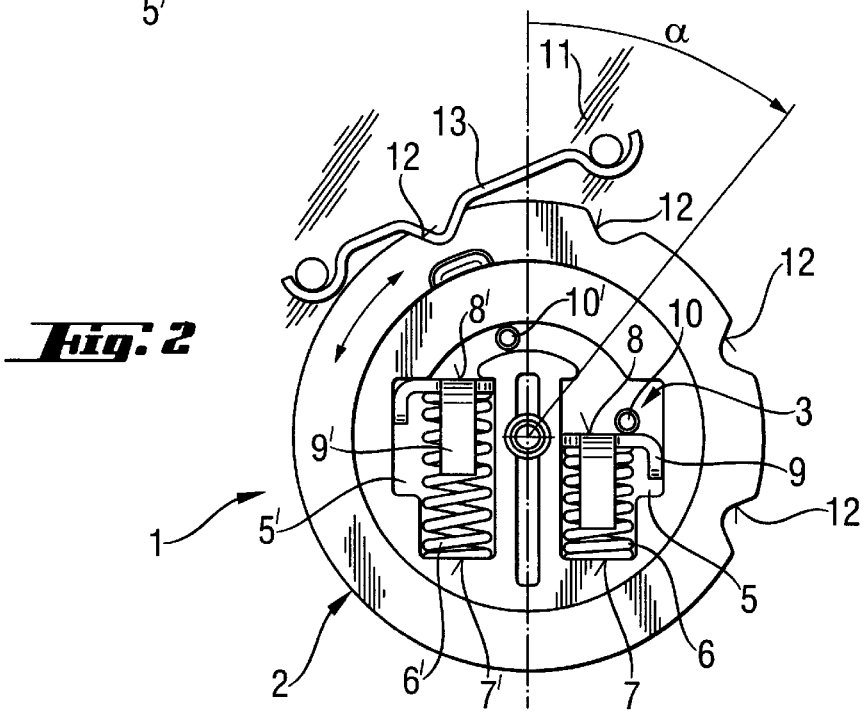
FIG. 2 illustrates a rotary mode selection switch with angle shift, in accordance with the invention.

Referring to FIG. 2, the mirror-symmetrically designed rotary mode selection switch 1 comprises an angle shift α between the driving member 2 and the driven member 3. Alternately, one spring element 6 is in contact with one eccentrically disposed contact piece 10, which engages into the recess 5, of the driven member 3 and one spring element 6' is without contact relative to the contact piece 10'. The absolute rotational position of the driving member 2 with respect to the housing 11 is self-limiting and set by a fixation means 13 that force-fittingly engages into a radial indentation 12 of the driving member 2, wherein the fixation means 13 is a flat spring.

What is claimed is:

1. A rotary mode selection switch for the synchronized switch over of an operating mode of a hand tool comprising a manually externally operated driving member (2) and a driven member (3), wherein the driving member (2) and the driven member (3) are axially fixed mounted and freely rotatable relative to one another, wherein the driving member (2) includes two eccentric recesses (5, 5') arranged perpendicular to the axis of rotation (A) for receiving two spring elements (6, 6') and the spring elements (6, 6') include initial front surfaces (7, 7') that contact the driving member (2) and second surfaces (8, 8') that are oriented in a same direction, such that with an angle shift (α) of the driving member (2) relative to the driven member (3), at least one of the second surfaces (8, 8') of the spring elements (6, 6') alternately contacts at least one eccentrically disposed contact piece (10, 10') engaged axially into the recesses (5, 5').

2. The rotary mode selection switch of claim 1, wherein the second surfaces (8, 8') of the spring elements (6, 6') are each provided with a covering, smooth pressure piece (9, 9').

3. The rotary mode selection switch of claim 1, wherein the recesses (5, 5') in the driving member (2) are disposed within a rotational plane perpendicular to the axis of rotation (A).

4. The rotary mode selection switch of claim 1, wherein the spring elements (6, 6') are compression springs.

5. The rotary mode selection switch of claim 4, wherein the spring elements (6, 6') are helical.

6. The rotary mode selection switch of claim 1, wherein an absolute rotational position of the driving member (2) relative to the housing (11) is fixable by a fixation means (13) that force-fittingly engages into a radial indentation (12) of the driving member (2).

7. The rotary mode selection switch of claim 6, wherein the fixation means (13) is a flat spring.

8. The rotary mode selection switch of claim 7, wherein the pin (4) is mounted freely rotatable in the driven member (3).

9. The rotary mode selection switch of claim 1, wherein a pin (4) is eccentrically disposed in the driven member (3).

10. The rotary mode selection switch of claim 1, wherein the two spring elements (6, 6') further comprise two smooth pressure pieces (9, 9') having angled leading surfaces and are eccentrically, axially engaged into the recesses (5, 5'), of the driven member (3).

* * * * *